United States Patent [19]

Kato et al.

[11] Patent Number: 4,860,686

[45] Date of Patent: Aug. 29, 1989

[54] COATING WIDTH REGULATING APPARATUS

[75] Inventors: Kenzo Kato; Kengi Yamada, both of Mihara, Japan

[73] Assignee: Beloit Corporation, Beloit, Wis.

[21] Appl. No.: 935,424

[22] Filed: Nov. 26, 1986

[51] Int. Cl.[4] ..... B05C 3/02

[52] U.S. Cl. ..... 118/410; 118/413

[58] Field of Search ..... 118/410, 413, 31.5, 118/500, 505, 407, 260; 206/818; 101/365

[56] References Cited

U.S. PATENT DOCUMENTS

| | | | |
|---|---|---|---|
| 3,302,678 | 2/1967 | Leguillon | 206/818 X |
| 3,331,351 | 7/1967 | Werner | 118/407 X |
| 4,398,494 | 8/1983 | Alheid | 118/410 |
| 4,413,561 | 11/1983 | Toyoda | 101/365 |

*Primary Examiner*—Shrive Beck
*Assistant Examiner*—Alain Bashore
*Attorney, Agent, or Firm*—Dirk J. Veneman; Raymond W. Campbell; Gerald A. Mathews

[57] ABSTRACT

An end seal for a blade coater is provided wherein an elastomeric seal is held in a case by a plurality of needle-like projections extending from the case. The case has at least one side adapted to seal against, and conform with, the surface of the coater blade and is magnetically attached to the blade. This permits quick, easy adjustment of the elastomeric material in the coater to change coating widths, or the rapid replacement of the worn elastomeric end seal.

4 Claims, 2 Drawing Sheets

PRIOR ART

COATING WIDTH REGULATING APPARATUS

BACKGROUND OF THE INVENTION

This invention relates to coaters for applying a fluid coating to a traveling web such as paper. More particularly, this invention relates to an apparatus for adjustably defining the width of the coating application to the traveling web. Still more particularly, this invention relates to a coater end seal wherein an elastomeric seal is adjustably mounted in place by virtue of its being attached to a case which is magnetically secured to the coating apparatus.

In certain types of coaters wherein an excess amount of fluidized coating material is brought into contact with a traveling web to be coated by the material, the web is supported by a backing roll while the fluidized coating material is metered onto the web by a blade which is biased against the web over the backing roll downstream of the point where the coating material is applied to the web. The backing roll has a face width which is greater than the width of the web to be coated so that the coating blade is supported for its entire length over the face of the backing roll. This type of configuration also requires a seal at either end of the coating blade to prevent migration of the coating material around the ends of the coating blade. Such leakage of the coating material is not only wasteful, but if the coating material gets around the edges of the web, it could undesirably coat the edge portion of the other side of the web, thus requiring subsequent trimming of the web to remove the edge portion which was undesirably coated.

This end seal at either edge of the coater blade is made of an elastomeric material in order to provide a conforming seal against the wiper which, in turn, is pressed against the edge of the web being coated.

Heretofore, this seal was attached to the coater blade by means of double-faced tape. This mounting arrangement works adequately, but it has two serious drawbacks. First, once the seal is installed, the tape will not permit any sliding movement and it cannot otherwise be easily moved to adjust for changes in the width of the web being coated or changes in the position of the seal against the edge of the web. Secondly, once the seal has been installed, it cannot be replaced without shutting down the coater and cleaning and drying all surfaces contacted by the tape because the coating material has previously covered all exposed areas of the blade as well as all exposed areas of adjacent apparatus. Thus, the tape cannot be reapplied to a dry area at any other location. This seriously limits both the effective life of the seal and also requires costly downtime in order to clean the blade to provide a dry spot to allow the tape to secure the seal against the blade.

SUMMARY OF THE INVENTION

This invention obviates the aforementioned drawbacks associated with mounting the end seal by means of double-faced tape. In this invention, the seal is secured on a clip-like case by means of mechanically impaling it on a plurality of needle-like projections on the case. This prevents relative movement of the seal and the case. The case is, in turn, magnetically secured to the coating apparatus, preferably by making the case magnetic and having one surface thereof conforming to a corresponding surface on the blade which is made of magnetically attractive material in order to become sealingly secured thereto.

Accordingly, it is an object of this invention to provide an improved, adjustable end seal for a blade coater.

It is another object of this invention to provide an improved end seal for a blade coater wherein the seal is both resilient and adjustably mounted to the coater.

Still another object of this invention is to provide an end seal for a coating apparatus wherein the seal can be quickly replaced or adjusted.

A feature of this invention is the provision of a seal-holding case which is magnetically mounted.

These, and other objects, features and advantages of the invention will become readily apparent to those skilled in the art when reading the description of the preferred embodiment in conjunction with the attached drawings.

DESCRIPTION OF THE PREFERRED EMBODIMENT

Figure 1:
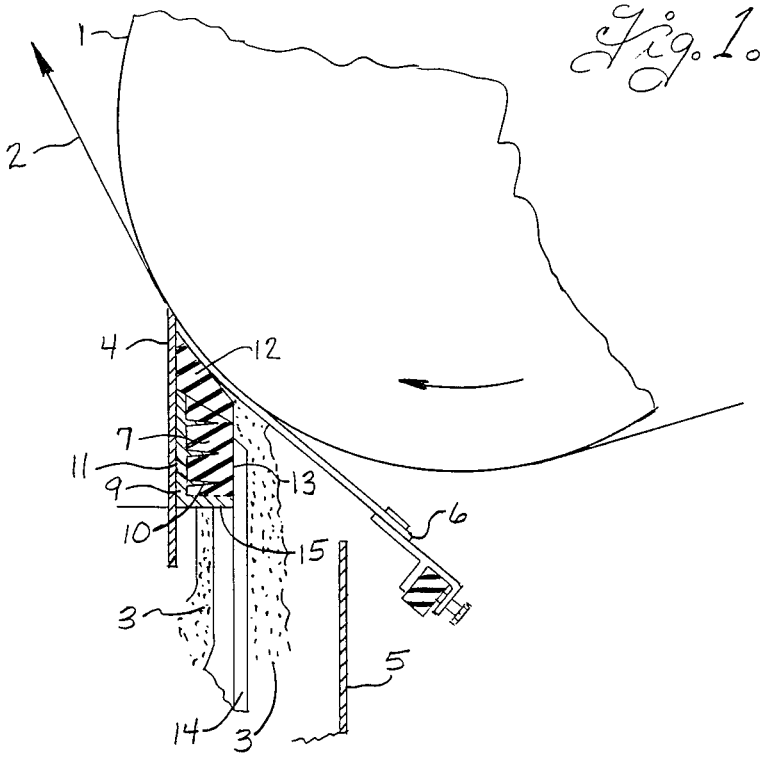
FIG. 1 is an end view, partially in section, of the end seal holding arrangement of this invention showing the seal mounted in the magnetic case and in operating position against the web on the backing roll.
Figure 2:
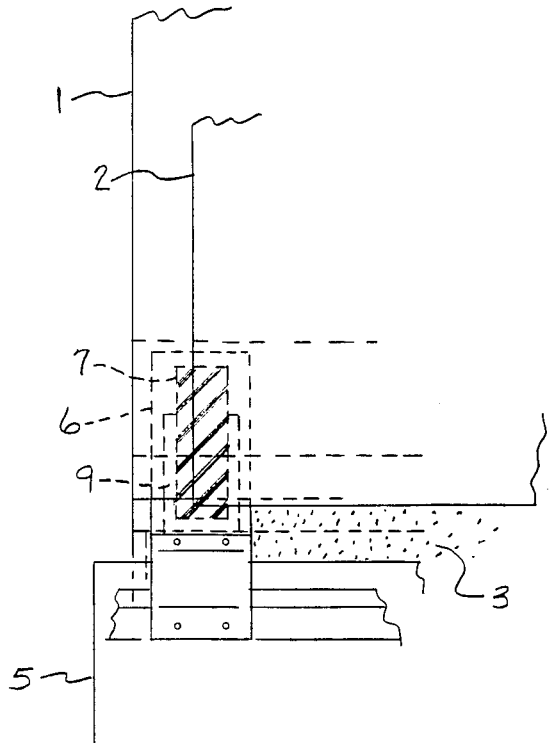
FIG. 2 is a front view of the apparatus as shown in FIG. 1.

As shown in FIGS. 1 and 2, a traveling web 2, such as paper, is supported on the surface of a backing roll 1 where it is engaged by a blade 4 to smooth and meter a supply of coating material 3 which has been brought into contact with the surface of the web. Coating blade 4 extends over the entire width of the web 2 and outwardly on either side thereof against the backing roll 1. The coating material, which in the papermaking industry is typically an aqueous slurry of clay and color, is brought into contact with the web over the surface of the backing roll by any of several means common in the industry. Such means include a fountain to provide an excess amount of coating material such as shown in FIG. 1, but may include other means such as immersing the web in a pool of coating material or applying the material via another roll nipping the web or the backing roll upstream of the blade.

As shown more clearly in FIG. 2, a flexible wiper blade 6 is disposed over the edge of the web on either end of the backing roll to prevent wear of the seal 7 against the traveling web. An elastomeric seal 7 made of, for example, sponge rubber, having a hardness of JIS (Japanese Industrial Standards) 20–25, is, in turn, held against the wiper on either end of the web to create a small dam to prevent movement of the coating material off either edge of the web on either side of the coater backing roll. This prevents loss of coating material as well as undesirable seepage of the coating material around the edges of the web against the roll.

The elastomeric seal 7 is held in a clip-like case member 9 by a plurality of rod-like needles 10 protruding from the case. Thus, the seal 7 is mechanically attached to the case 9.

In a preferred embodiment, case 9 is made of a magnetic material such as magnetized iron or ceramic, and has one or more surfaces such as flat, back surface 11 on one wall which conforms with the flat surface of blade 4 which is made of a magnetically conductive material such as steel, so that the elastomeric end seal member 7 is securely held in position with one end surface 12 assuming the contour shape of the backing roll 1 over the outer surface of wiper 6. In the preferred embodiment, there is also a bottom surface 15 on another wall to support the seal. Thus, case 9 has two open sides. The magnetic case in which it is mounted is magnetically secured to the blade 4 so that the interface therebetween is sealed along the contiguous back surface 11 of the end seal. Similarly, the resilience of the end seal 7 holds the front surface 13 against the seal flange 14. This effectively forms an end dam seal having a thickness equal to the distance between surfaces 11, 13 to prevent the excess coating material 3 from migrating outwardly beyond the edge of the web 2. The excess coating doctored off by the blade 4 falls between end seals 7 on either side of the coater downwardly into the pan 5 which has its upper lip 5 shown in FIGS. 1 and 2.

In operation, as a coating material 3 is applied to the web 2 across the full width of the coater, the flexible wiper 6 is held against either edge of the web 2 by the elastomeric seal 7 which, in turn, is held by the magnetic case 9 to provide an end dam at either end of the backing roll 1 over the edges of web 2 to prevent migration of the coating material around the edges of the web 2 and off either end of the backing roll. Blade 4 meters the desired amount of coating material onto web 2 and directs the excess coating material downwardly between either edge of web 2.

Figure 3:
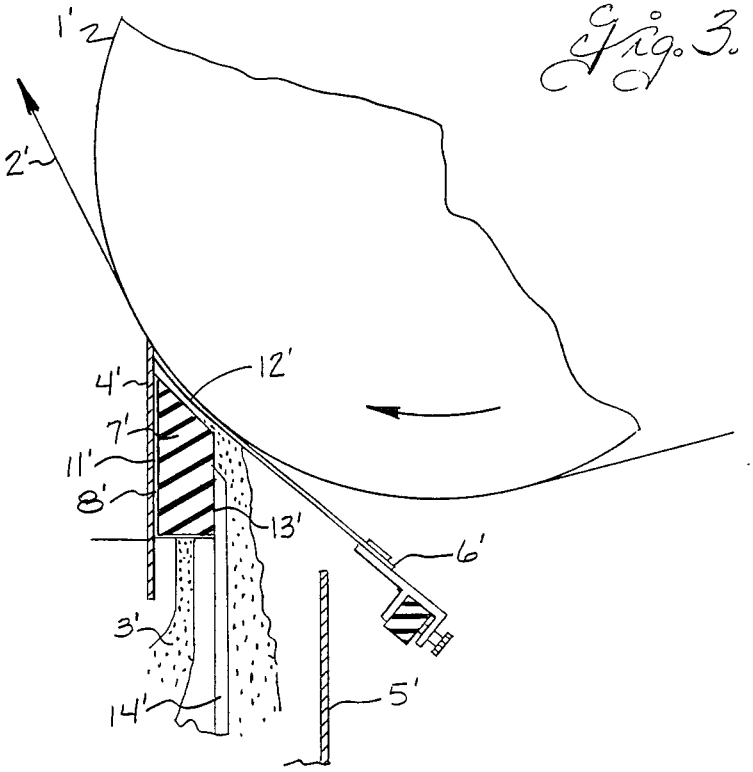
FIG. 3 is an end view of the blade holder showing the prior art type of elastomeric seal held in the holder by double-faced tape.
Figure 4:
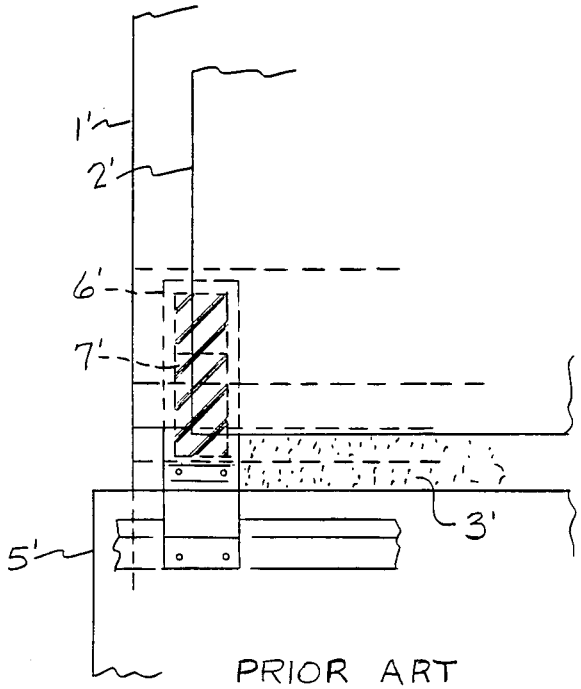
PRIOR ART Fig. 4.
FIG. 4 is a front elevational view of the apparatus shown in FIG. 3.

In the prior art arrangement shown in FIGS. 3 and 4, where corresponding elements have corresponding primed numeral designations, the elastomeric seal member 7' is mounted in the apparatus by being directly attached to the blade 4' by means of a strip of two-faced adhesive tape 8'. The elastomeric member 7' thus provides an end dam seal at either end of the backing roll 1' over the edges of web 2' at the interfaces of the blade and structure with seal surfaces 11', 12' and 13' in a manner similar to the arrangement shown in FIG. 1.

However, the aqueous slurry of coating material 3' contacts the surfaces of blade 4' and seal holder support flange 14'. This means that even if seal 7' is moved to accommodate a change in width of the web being coater, or if it is completely replaced, the tape will not adhere to any other surface unless the entire apparatus is cleaned and dried. Thus, end seals installed with two-faced adhesive tape cannot be moved or adjusted, and new seals cannot be installed until the entire apparatus is taken out of operation, cleaned and dried.

With the apparatus of this invention, the mounting of the elastomeric seal 7 on the rod-like needles 10 and making the case 9 magnetically attached to blade 10, the seal 7 is adapted to be easily moved, adjusted—or even replaced in its operating position independently of the surface condition, particularly with respect to the degree of wetness, of the surfaces against which it is mounted. Further, the end seal which is replaced, is not damaged and may be reconditioned and used again.

Thus, a blade coater seal arrangement has been provided which achieves the objects, and includes the features set forth. Obviously, various details of the invention can be changed without departing from the spirit and scope of the invention as claimed. For example, the magnetic mounting of the seal 7 on the blade 4 can be achieved by making the blade of a magnetic material which, in turn, would be magnetically secured to the case 9 by virtue of making case 9 of magnetically-conductive material. Similarly, the elastomeric seal 7 could be attached to case 9 by screws, hooks, or other mechanical means.

We claim:

1. In a coating apparatus wherein a liquid coating material is applied to a travelling web supported on a backing roll, including a coater blade, and an end seal, and end seal support flange means near either end of the backing roll, the improvement comprising:

a case having a mechanical means for securing the end seal thereon;

means for magnetically securing the case to the coater blade to provide a sealing relationship, and relative movement, between the case with end seal and coater blade.

2. The apparatus as set forth in claim 1, wherein:

the case includes a surface adapted to conform, and be mounted contiguous, with the blade to establish a movable sealing relationship therewith.

3. The apparatus as set forth in claim 1, wherein:

the mechanical means includes rod-like needles projecting into the seal.

4. The apparatus as set forth in claim 1, wherein:

the case comprises a magnetic material and the blade comprises a magnetically-conductive material to thereby establish adjustable attachment therebetween.

* * * * *